US006979099B2

(12) United States Patent
Harris, Jr. et al.

(10) Patent No.: US 6,979,099 B2
(45) Date of Patent: Dec. 27, 2005

(54) PORTABLE LIGHTING DEVICE WITH MULTI-ACTIVATION SWITCH

(75) Inventors: Kenneth David Harris, Jr., Nashua, NH (US); Joesph Geringer, Merrimack, NH (US); Baird Litle, Nashua, NH (US); Steve Schwartz, Bedford, NH (US); Charles J. Burout, Bedford, NH (US); Jay D. Newcomer, Manchester, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 57 days.

(21) Appl. No.: 10/777,844

(22) Filed: Feb. 12, 2004

(65) Prior Publication Data

US 2005/0180130 A1 Aug. 18, 2005

(51) Int. Cl.[7] ..... F21V 33/00

(52) U.S. Cl. ..... 362/184; 362/394; 362/276; 200/1 B; 200/5 R; 200/17 R

(58) Field of Search ..... 362/183, 184, 362/194, 205, 212, 236, 240, 251, 253, 276, 362/394, 800, 802; 200/1 B, 60, 4, 5 R, 6 A, 200/17 R, 18; 340/815.67

(56) References Cited

U.S. PATENT DOCUMENTS 4,359,614 A * 11/1982 Green et al. ..... 200/5 R
5,077,644 A * 12/1991 Schaller et al. ..... 362/184
5,824,978 A * 10/1998 Karasik et al. ..... 200/18
6,000,811 A * 12/1999 Bordak ..... 362/158
D475,195 S 6/2003 Christianson
6,623,140 B2 * 9/2003 Watterson et al. ..... 362/184
6,809,273 B2 * 10/2004 Ito et al. ..... 200/5 R
2004/0141316 A1 * 7/2004 Twardawski ..... 362/184
2004/0174525 A1 * 9/2004 Mullani ..... 356/369

OTHER PUBLICATIONS www.sharperimage.com/us/en/catalog/productdetails.jhtml ?sku=S1782WHT,"Chrome Key Organizer With Ultra-Bright Dual LED Torch", pps. 1-2, date printed Aug. 22, 2005.

* cited by examiner

*Primary Examiner*—Stephen Husar
*Assistant Examiner*—Hargobind S. Sawhney
(74) *Attorney, Agent, or Firm*—Nixon Peabody LLP

(57) ABSTRACT

A portable lighting device comprising a power source, a first light source, a second light source, and a switch. A first circuit electrically couples the power source, a switch, and the first light source. A second circuit electrically couples, the power source, the switch, and the second light source. The switch comprises a first surface portion, a second surface portion, and a third surface portion wherein pressing the first surface portion closes the first circuit, pressing the second surface portion closes the second circuit, and pressing the third surface portion closes both the first and the second circuit. The switch also has a forward position that closes the first circuit and a backward position that closes the second circuit.

20 Claims, 6 Drawing Sheets

PORTABLE LIGHTING DEVICE WITH MULTI-ACTIVATION SWITCH

FIELD OF THE INVENTION

The present invention is generally related to portable lighting devices, and more particularly is related to a portable lighting device with multiple light sources and a multi-activation switch.

BACKGROUND OF THE INVENTION

Portable lighting devices are commonly referred to as "flashlights". Flashlights provide a source of light when natural light is inadequate or lack of a utility outlet prevents use of a plug-in lamp. Portable lighting devices generally contain a light source, a switch, and a power source. An electrical circuit electrically couples the light source, switch, and power source. A user activates the light source by activating the switch, which closes the electrical circuit. The switch is generally a mechanism for electrically coupling two posts located on the circuit. Closing the electrical circuit allows current from the power source to flow to the light source. One or more batteries with a negative terminal and a positive terminal are commonly used as the power source. An incandescent light bulb with two terminals is commonly used as the light source. One of the light bulb terminals connects to the positive terminal of the battery and one of the light bulb terminals connects to one of the posts on the switch. The negative terminal on the battery connects to the other post on the switch. By activating the switch, the two posts on the switch are connected. This allows the current to flow through the circuit and power the light bulb.

Portable lighting devices have been attached to key chains to provide quick and convenient access to the portable lighting device. Because keys are normally stored in the pocket of a user, smaller components are desirable allowing the overall portable lighting device to be small. It is also desirable for the portable lighting device to be produced inexpensively.

Thus, a heretofore unaddressed need exists in the industry to address the aforementioned deficiencies and inadequacies.

SUMMARY OF THE INVENTION

In one aspect, the invention features a portable lighting device comprising a power source, a first light source, a second light source, and a switch. A first circuit electrically couples the power source, the switch, and the first light. A second circuit electrically couples the power source, the switch, and the second light source. The switch comprises a first surface portion, a second surface portion, and a third surface portion wherein pressing the first surface portion closes the first circuit, pressing the second surface portion closes the second circuit, and pressing the third surface portion closes both the first and the second circuit.

The switch can have a first locked position that closes the first circuit and a second locked position that closes the second circuit. The switch can also have a first locked position that closes the first circuit and closes the second circuit and a second locked position that closes the second circuit. The first light source and the second light source can be light emitting diodes. The power source can be a battery. A non-conductive housing can hold the power source, the first light source, the first circuit, the second light source, and the second circuit in place. The non-conductive housing can also form the switching mechanism.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
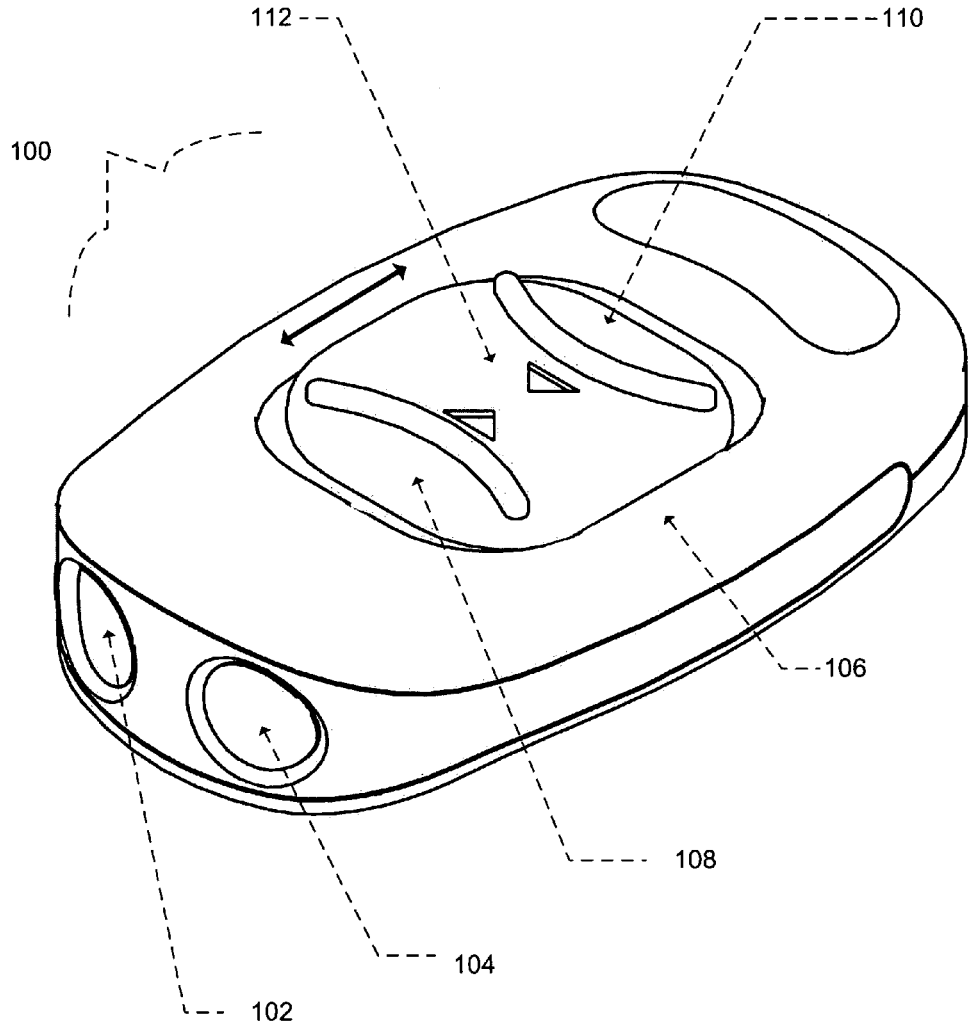
FIG. 1 is a perspective view of the portable lighting device.
Figure 2:
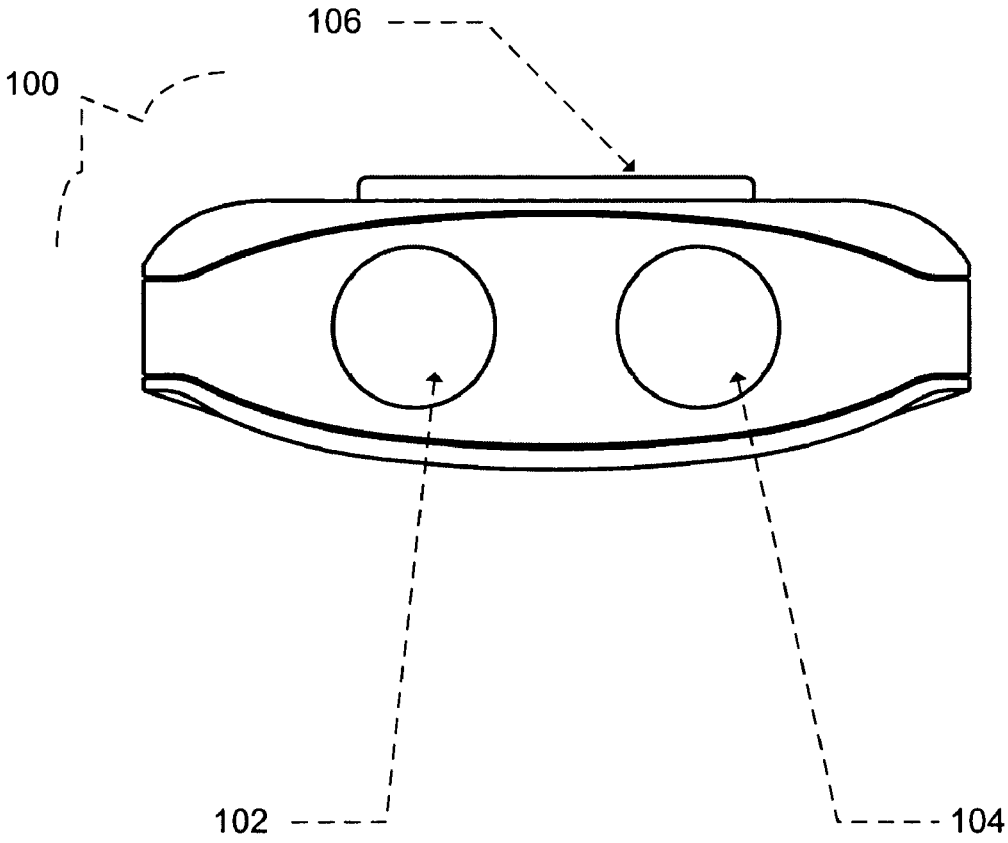
FIG. 2 is a front view of the portable lighting device.

FIG. 1 is a perspective view and FIG. 2 is a front view of the portable lighting device 100. The portable lighting device 100 contains a first light source 102 and a second light source 104. A variety of lighting devices can be used as the first light source 102 and second light source 104, for example, however not limited to, an incandescent light bulb or a Light Emitting Diode (LED). The first light source 102 and second light source 104 can provide the same color of light or each can provide different colors of light.

A switch plate 106 allows the user to activate and deactivate the first light source 102 and the second light source 104. The switch plate 106 is a top portion of a switch 306, which is described in more detail in the description associated with FIGS. 3–6. In the embodiment shown in FIG. 1, the switch plate 106 is located on the top surface of the portable lighting device 100. However, it will be apparent that the switch plate 106 can be located in different locations and surfaces of the portable lighting device 100. The switch plate 106 has a front portion 108, a back portion 110, and a middle portion 112. The user can selectively activate the first light source 102, the second light source 104, or both the first and second light sources 102 and 104 by pressing downward on the different portions 108, 110, and 112 of the switch plate 106. When the user presses down on the front portion 108 of the switch plate 106, the first light source 102 is activated. When the user releases the front portion 108, the first light source 102 is deactivated. Similarly, a user can activate the second light source 104 by pressing down on the back portion 110, or respectively release pressure on the back portion 110 to deactivate the second light source 104. Applying pressure to the middle portion 112 allows the user to activate both the first light source 102 and the second light source 104. Similarly, the user can deactivate both light sources by releasing pressure on the middle portion 112.

Figure 4:
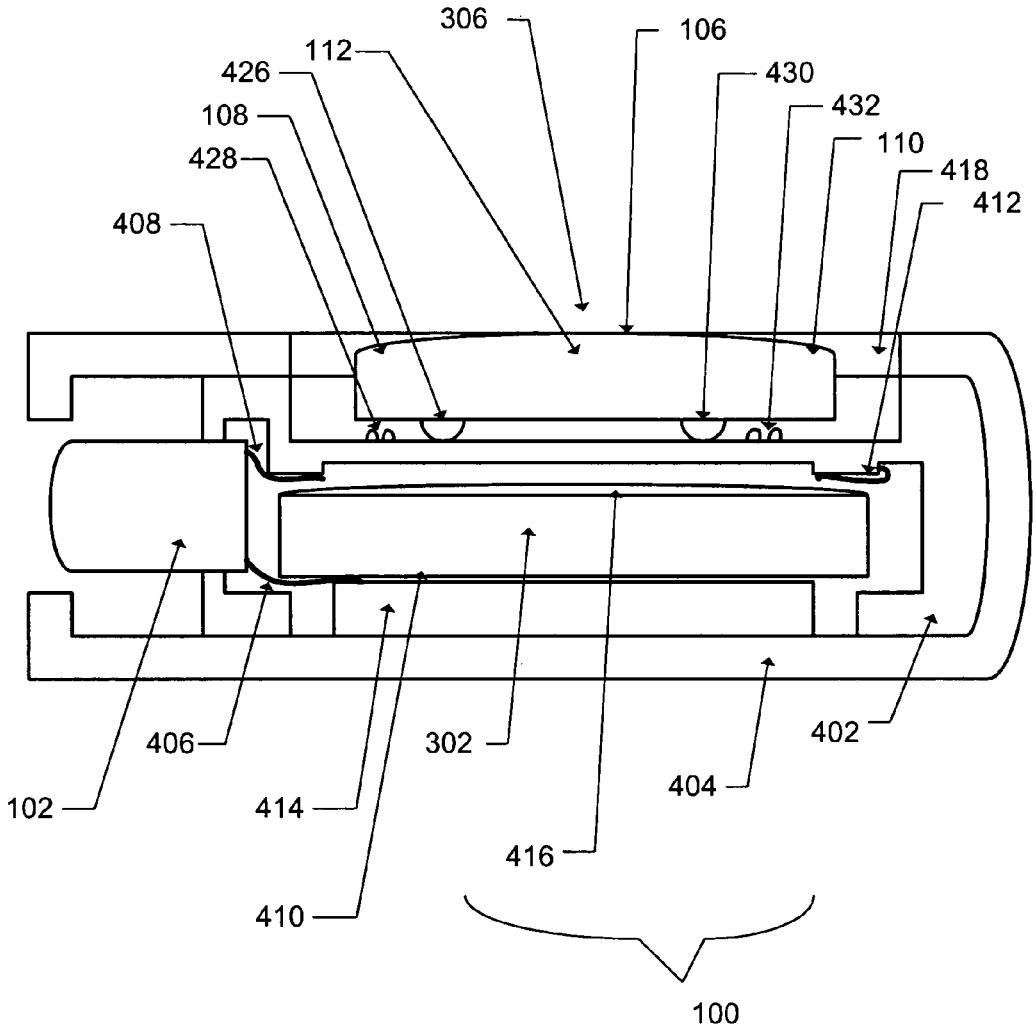
FIG. 4 is a cross-sectional side view of the portable lighting device with the switch plate in a middle position.
Figure 5:
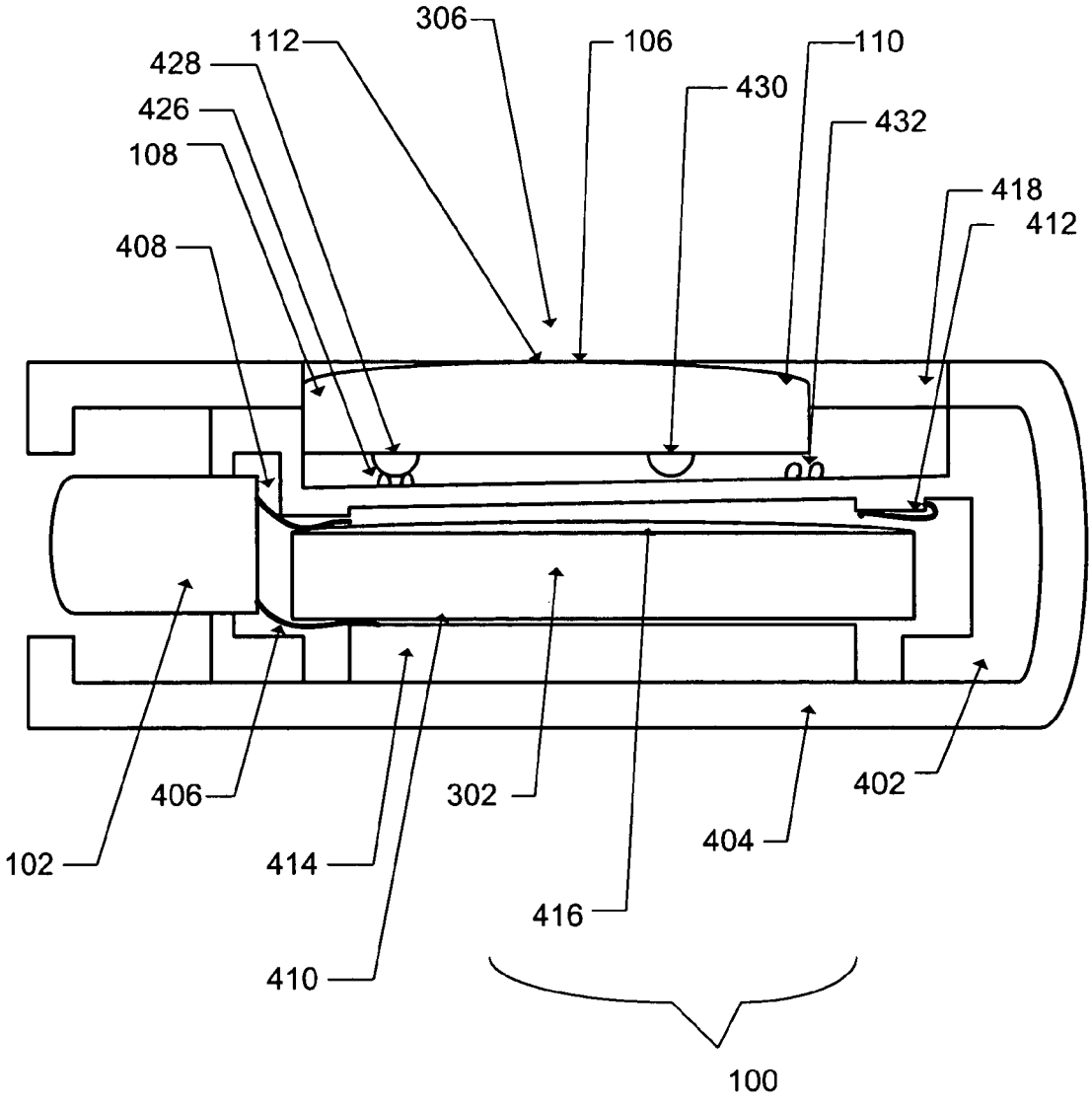
FIG. 5 is a cross-sectional side view of the portable lighting device with the switch plate in a forward position.
Figure 6:
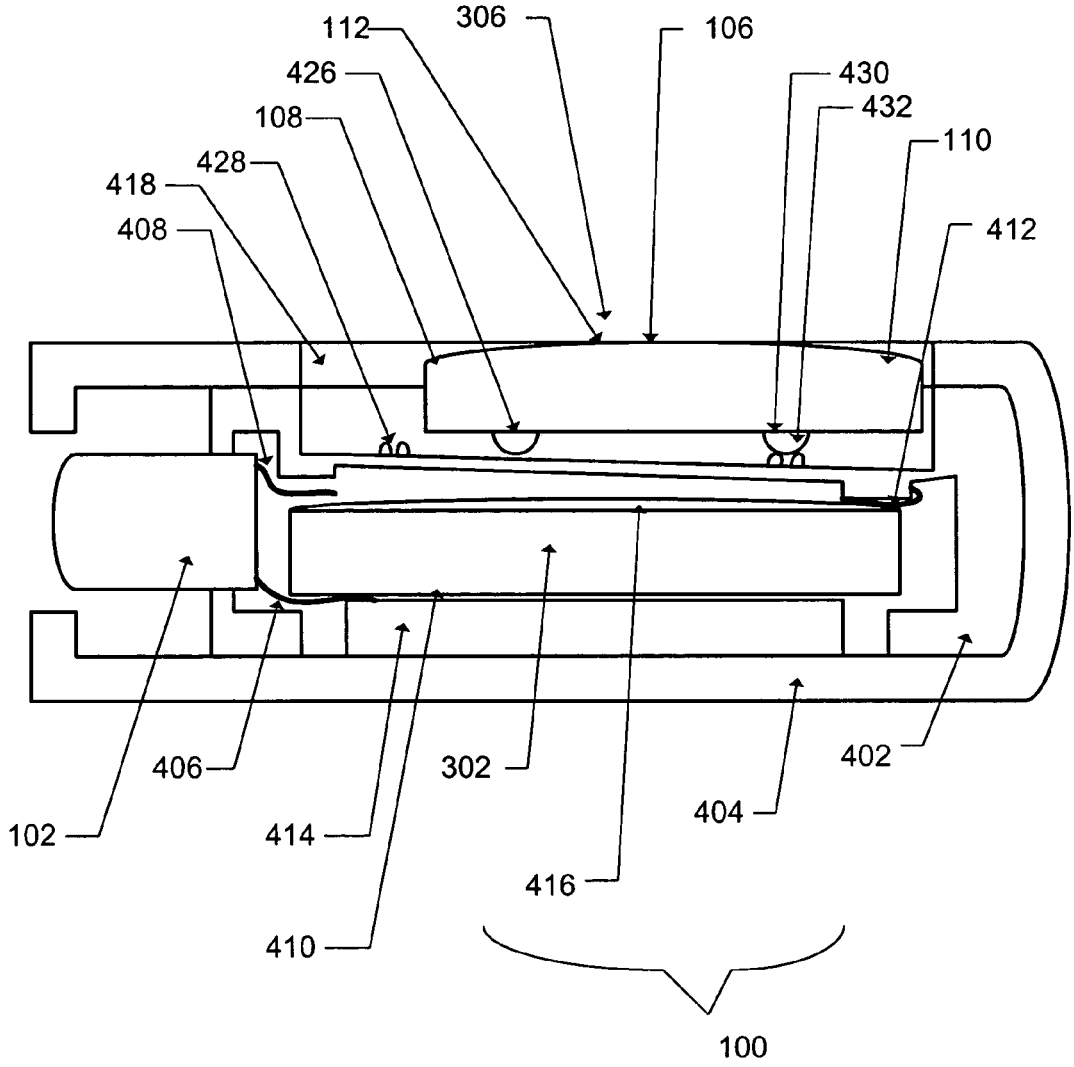
FIG. 6 is a cross-sectional side view of the portable lighting device with the switch plate in a backward position.

In addition to temporarily activating the first light source 102 and the second light source 104 by applying continuous pressure downward on the switch plate 106, the user can also activate the light sources 102 and 104 by sliding the switch plate 106 in a forward direction or backward direction as shown by the arrow in FIG. 1. The user can slide the switch 106 into a forward position (as shown in FIG. 5) or backward position (as shown in FIG. 6). Unlike the transitory position of pressing downward on the various portions 108, 110, and 112 of the switch plate 106, the switch plate 106 remains in either the forward position or the backward position until the user moves the switch. This allows the user to turn either the first light source 102 or the second light source 104 "on" and leave them "on" for extended use without applying continuous pressure to the surface of the switch plate 106. When the portable lighting device 100 is not in use the switch plate 106 remains in a middle position (as shown in FIG. 4), in which neither the first light source 102, nor the second light source 104 is activated.

Figure 3:
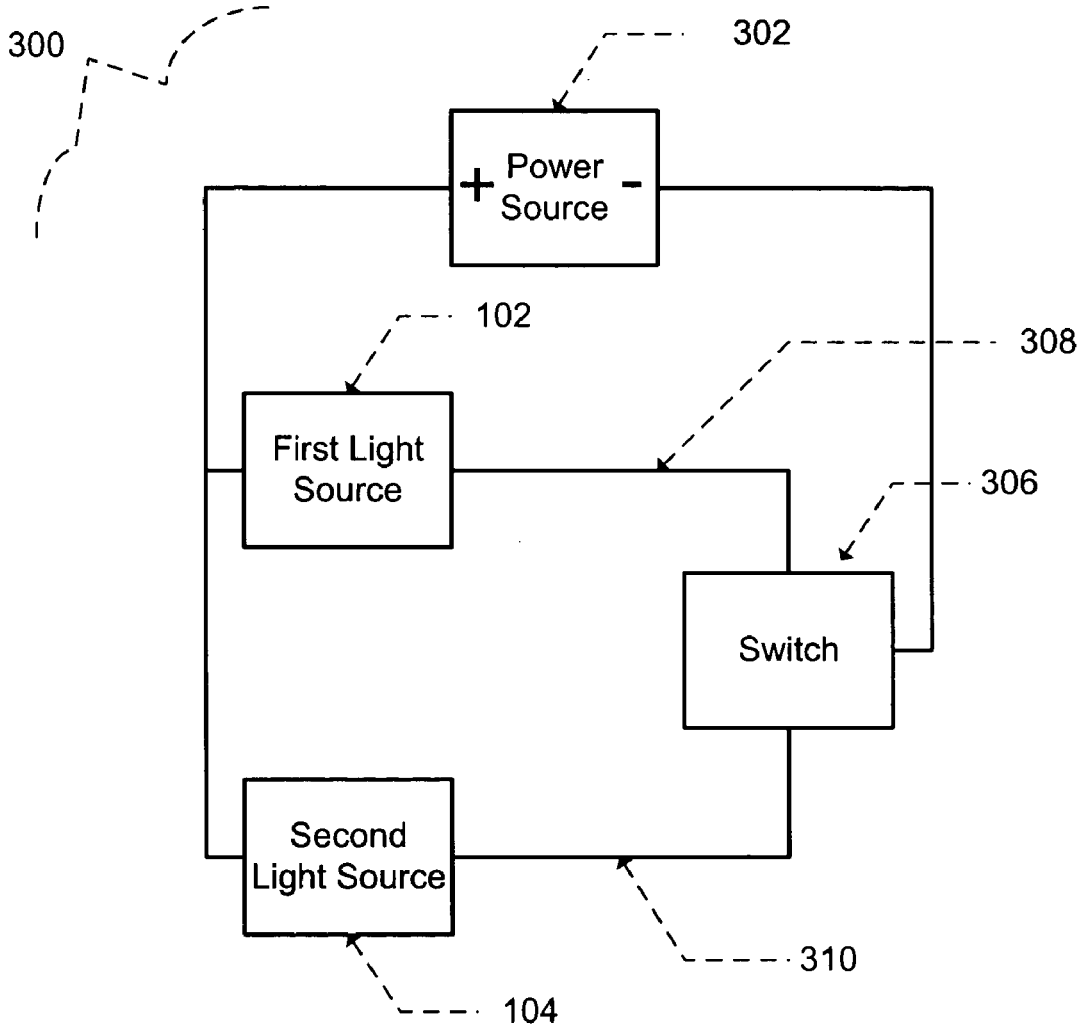
FIG. 3 is a block diagram illustrating the interaction of components of the portable lighting device.

FIG. 3 is a block diagram illustrating the interaction of the components of the portable lighting device 300. The switch 306 selectively couples the power source 302 to the first light source 102 and the second light source 104. The power source 302 is described in greater detail in the sections associated with FIGS. 4–6.

When the switch plate 106 is in the forward position or the front portion 108 of the switch plate 106 is pressed down, the switch 306 electrically couples the power source 302 to the first light source 102. This allows current to flow through a first circuit 308. The first circuit 308 follows an electrical path from the power source 302, through the switch 306 and the first light source 102, and back to the power source 302. When the switch plate 106 is in a backward position or the back portion 110 of the switch plate 106 is pressed down, the switch 306 electrically couples the power source 302 to the second light source 104. This allows current to flow through a second circuit 310. The second circuit 310 follows an electrical path from the power source 302, through the switch 306 and the second light source 104, and back to the power source 302.

When the middle portion 112 of the switch plate 106 is pressed down, the switch 306 electrically couples the power source 302 to the first light source 102 and the second light source 104. This allows current to flow through the first circuit 308 and the second circuit 310. The first circuit 308 follows an electrical path from the power source 302, through the switch 306 and the first light source 102, and back to the power source 302. The second circuit 310 allows the current to flow in parallel with the first circuit 308. The current also follows an electrical path from the power source 302, through the switch 306 and the second light source 104, and back to the power source 302. When the switch plate 106 is in a middle position, both the first circuit 308 and second circuit 310 are open and current is prevented from flowing through either the first circuit 308 or the second circuit 310.

FIG. 4 is a cross-sectional side view of the portable lighting device 100 with the switch plate 106 in a middle position. The switch plate 106 comprises the front portion 108, back portion 110, and middle portion 112 as shown both in FIGS. 1 and 4. The switch plate 106 is slidably coupled to an interior housing 402. The interior housing 402 can be made of a non-conductive material and is encased by an exterior housing 404. The exterior housing 404 holds the components of the portable lighting device 100 together. An aperture 418 in the exterior housing 404 allows the switch plate 106 to be accessed by the user and moved into both the forward position and the backward position.

The interior housing 402 and exterior housing 404 can also be constructed as one housing with a top half and a bottom half. In this scenario (not shown), the components can be assembled within the housing and then the top half and bottom half of the housing can be coupled together. The housing for the portable lighting device 100, as described in the examples above, are examples used to illustrate possible housings for the portable lighting device 100. The portable lighting device 100 is not limited to the housing examples described above. A variety of other housing can be used.

The power source 302 is housed within the interior housing. A positive lead 406 from the first light source 102 is electrically coupled to a positive terminal 410 of the power source 302. A cushiony material, for example but not limited to rubber or foam, presses the positive lead 406 against the positive terminal 410 of the power source 302. Similarly, a positive lead (not shown) from the second light source 104 is also electrically coupled to the positive terminal 410 of the power source 302.

A negative lead 408 from the first light source 102 is positioned in-between a negative terminal 416 of the power source 302 and the interior housing 402. The negative lead 408 from the first light source 102 rests against the interior housing so as not to make unintended electrical contact with a negative terminal 416 of the power source 302. The negative lead 408 can also be coupled to the interior housing by glue or other fastener to prevent unintended contact with the negative terminal 416 of the power source 302. When a force is applied to the front portion 108 or middle portion 112 of the switch plate 106, the interior housing 402 and negative lead 408 are pressed downward against the negative terminal 416 of the power source 302. This closes the first circuit 308 and activates the first light source 102. Once the force is released from the front portion 108 or middle portion 112 of the switch plate 106, the negative lead 408 separates from the negative terminal 416 of the power source 302 and the first circuit 308 is opened.

Similarly, a negative lead 412 from the second light source 104 is positioned in between the negative terminal 416 of the power source 302 and the interior housing 402. The negative lead 412 from the second light source 104 rests against the interior housing 402 so as not to make unintended electrical contact with the negative terminal 416 of the power source 302. The negative lead 412 can also be coupled to the interior housing by glue or other fastener to prevent unintended contact with the negative terminal 416 of the power source 302. When a force is applied to the back portion 110 or middle portion 112 of the switch plate 106, the interior housing and negative lead 412 are pressed downward against the negative terminal 416 of the power source 302. Once the force is released from the back portion 110 or middle portion 112 of the switch plate 106, the negative lead 412 separates from the negative terminal of the power source 302 and the second circuit 310 is opened.

The interior housing 402, switch plate 106, the negative lead 408 from the first light source 102, and the negative lead 412 from the second light source 104 form the switch 306. Pressing downward on the front portion 108 of the switch plate 106 presses the negative lead 408 from the first light source 102 into contact with the negative terminal 416 of the power source 302, thereby completing the first circuit 308. Similarly, pressing downward on the back portion 110 of the switch plate 106 presses the negative lead 412 from the second light source 104 into contact with the negative terminal 416 of the power source 302 thereby completing the second circuit 310. Pressing downward on the middle portion 112 of the switch plate 106 presses the negative lead 408 from the first light source 102 and the negative lead 412 from the second light source 104 into contact with the negative terminal 416 of the power source 302, thereby completing the first circuit 308 and the second circuit 310.

A front nub 426 on a bottom portion of the switch 306 and a back nub 432, also located a bottom portion of the switch 306 hold the switch 306 in position. When the switch 306 is in the middle position (as shown in FIG. 4), the front nub 426 and a front notch 428 prevent the switch 306 from sliding into the forward position (as shown in FIG. 5) until the user applies a frontal force to the switch plate 106. Similarly, the back nub 430 and a back notch 432 prevent the switch 306 from sliding into the backward position (as shown in FIG. 6) until the user applies a backward force to the switch plate 106. When the switch is in the middle position neither the negative lead 408 from the first light source 102 nor the negative lead 412 from the second light source 104 are in contact with the negative terminal 416 of the power source 302. Both the first light source 102 and second light source 104 are "off". The user may still activate the light sources 102 and 104 by applying and maintaining a downward force to the switch plate 106. If the user desires to activate the first light source 102 without maintaining a downward force on the front portion 108 of the switch plate 106, the user can slide the switch plate 106 in a forward position (as shown in FIG. 5).

FIG. 5 is a cross-sectional side view of the portable lighting device 100 with the switch 306 in a forward position. The user can slide the switch 306 into the forward position by applying a frontal force on the switch plate 106. As a result of the frontal force, the front nub 426 rides up and over the front notch 428 and the exterior housing 404 presses the switch 306 against the interior housing 402. The extra space necessary for the front nub 426 to rest on top of the front notch 429 presses the negative lead 408 from the first light source 102 into contact with the negative terminal 416 of the power source 302, thereby completing the first circuit 308. The front notch 428 holds the front nub 426 of the switch plate 106 in place without the user applying any force to the switch 306. The first light source 102 remains "on" until the user applies a backward force to the switch plate. Once the user supplies sufficient force to slide the front nub 426 out of the front notch 428, the switch 306 slides back into the middle position. The negative lead 408 then separates from the negative terminal 416 of the power source 302 and the first light source 102 is turned "off".

FIG. 6 is a cross-sectional side view of the portable lighting device 100 with the switch 306 in a backward position. The user can slide the switch 306 into the backward position by applying a backward force on the switch plate 106. As a result of the backward force, the back nub 430 rides up and over the back notch 432 and the exterior housing 404 presses the switch 306 against the interior housing 402. The extra space necessary for the back nub 430 to rest on top of the back notch 432 presses the negative lead 412 from the second light source 104 into contact with the negative terminal 416 of the power source 302, thereby completing the second circuit 310. The back notch 432 holds the back nub 430 of the switch 306 in place without the user applying any force to the switch plate 106. The second light source 104 remains "on" until the user applies a frontal force to the switch plate 106. Once the user supplies sufficient force to slide the back nub 430 out of the back notch 432, the switch 306 slides back into the middle position. The negative lead 412 then separates from the negative terminal of the power source 302 and the second light source 104 is turned "off".

In another example of the portable lighting device 100, a variety of color combinations can be used for the light sources 102 and 104. The portable lighting device 100 with different colors of light sources allows a user to use different colors of light for different applications. For example, the first light source 102 may emit red light, while the second light source 104 may emit a white light. When using the portable lighting device 100 in an application where the user does not wish to disturb others, the user may wish to activate only the first light source 102 and take advantage of the high dispersion of the red light emitted by the first light source 102. However, in other applications when the user desires to better identify an item in the dark, the user may wish to emit the white light of the second light source 104. The light sources 102, 104 are not limited to red and white. Light sources with a variety of colors, for example but not limited to, red, blue, green, turquoise, yellow, purple, and white, can be used with the portable lighting device 100. In addition, the first light source 102 and second light source 104 are not limited to the combination of red and white. A variety of color combinations can be used for the light sources 102, 104.

For example, the portable lighting device 100 may have the first lighting source 102 and the second lighting source 104 providing the same color of light. In this example, the user can select different amounts of the light emitted for different applications. A user may desire a modest amount of light and activate only the first light source 102. In another situation, the user may desire more light and select to activate both the first light source 102 and the second light source 104.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A portable lighting device, comprising:

a power source;

a first light source;

a first circuit that electrically couples the power source, a switch, and the first light;

a second light source;

a second circuit that electrically couples the power source, the switch, and the second light source; and the switch comprising a first surface portion, a second surface portion, and a third surface portion wherein pressing the first surface portion closes the first circuit, pressing the second surface portion closes the second circuit, and pressing the third surface portion closes both the first and the second circuit.

2. The device of claim 1, wherein the switch has a first locked position that closes the first circuit and a second locked position that closes the second circuit.

3. The device of claim 1, wherein the switch has a first locked position that closes the first circuit and closes the second circuit and a second locked position that closes the second circuit.

4. The device of claim 1, wherein the first light source and the second light source are light emitting diodes.

5. The device of claim 1, wherein the power source is a battery.

6. The device of claim 1, further comprising a non-conductive housing wherein the non-conductive housing holds the power source, the first light source, the first circuit, the second light source, and the second circuit in place.

7. The device of claim 6, wherein the non-conductive housing forms the switch.

8. The device of claim 1, wherein the means for switching has a first locked position that closes the first circuit and closes the second circuit and a second locked position that closes the second circuit.

9. The device of claim 1, further comprising a means for housing wherein the means for housing holds the means for powering, the first means for producing light, the first circuit, the second means for producing light, and the second circuit in place.

10. The device of claim 9, wherein the means for housing is non-conductive.

11. A flashlight, comprising:

a power source;

a first light source;

a first circuit that electrically couples the power source, a switch, and the first light source;

a second light source;

a second circuit that electrically couples the power source, the switch, and the second light source;

the switch;

a first housing wherein the first housing holds the power source, the first light source, the first circuit, the second light source, and the second circuit in place; and a switch plate slidably coupled to the first housing comprising a first surface portion, a second surface portion, and a third surface portion wherein pressing the first surface portion closes the first circuit, pressing the second surface portion closes the second circuit, and pressing the third surface portion closes both the first and the second circuit, and the switch plate has a forward position that closes the first circuit and a backward position that closes the second circuit.

12. The flashlight of claim 11, wherein the switch plate has a forward position that closes the first circuit and closes the second circuit and a backward position that closes the second circuit.

13. The flashlight of claim 11, wherein the first light source and the second light source are light emitting diodes.

14. The flashlight of claim 11, wherein the power source is a battery.

15. The flashlight of claim 11, wherein the first housing is non-conductive.

16. The flashlight of claim 15, further comprising a metal, exterior housing wherein the first housing is secured within the exterior housing.

17. The flashlight of claim 11, further comprising an exterior housing wherein the first housing is secured within the exterior housing.

18. The flashlight of claim 16, wherein the exterior housing is coupled to a keychain.

19. A portable light device, comprising:

a means for powering;

a first means for producing light;

a first circuit that electrically couples the means for powering, a means for switching, and the first means for producing light;

a second means for producing light;

a second circuit that electrically couples the means for powering, the means for switching, and the second means for producing light; and the means for switching comprising a first surface portion, a second surface portion, and a third surface portion wherein pressing the first surface portion closes the first circuit, pressing the second surface portion closes the second circuit, and pressing the third surface portion closes both the first and the second circuit.

20. The device of claim 19, wherein the means for switching has a first locked position that closes the first circuit and a second locked position that closes the second circuit.

* * * * *